US011933148B2

(12) United States Patent
Wilson

(10) Patent No.: US 11,933,148 B2
(45) Date of Patent: Mar. 19, 2024

(54) TRI-ANGLED LINER WITH JET SHAPER

(71) Applicant: Hunting Titan, Inc., Pampa, TX (US)

(72) Inventor: Shane Matthew Wilson, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 97 days.

(21) Appl. No.: 17/617,886

(22) PCT Filed: Jun. 12, 2020

(86) PCT No.: PCT/US2020/037622
§ 371 (c)(1),
(2) Date: Dec. 9, 2021

(87) PCT Pub. No.: WO2020/252403
PCT Pub. Date: Dec. 17, 2020

(65) Prior Publication Data

US 2022/0298895 A1 Sep. 22, 2022

Related U.S. Application Data

(60) Provisional application No. 62/860,682, filed on Jun. 12, 2019.

(51) Int. Cl.
*E21B 43/117* (2006.01)
*F42B 1/028* (2006.01)
*F42B 1/032* (2006.01)

(52) U.S. Cl.
CPC ..... *E21B 43/117* (2013.01); *F42B 1/028* (2013.01); *F42B 1/032* (2013.01)

(58) Field of Classification Search
CPC ..... E21B 43/117; F42B 1/028; F42B 1/032
USPC ..... 102/476
See application file for complete search history.

(56) References Cited

U.S. PATENT DOCUMENTS

| | | | | | |
|---|---|---|---|---|---|
| 2,856,850 | A * | 10/1958 | Church | F42B 1/02 | 29/421.2 |
| 3,269,467 | A * | 8/1966 | Bell | F42B 1/028 | 175/4.51 |
| 3,478,685 | A * | 11/1969 | Thomanek | F42B 1/028 | 102/306 |
| 4,436,033 | A * | 3/1984 | Precoul | F42B 1/028 | 102/307 |
| 5,509,356 | A * | 4/1996 | Renfro | F42B 1/028 | 102/307 |
| 6,840,178 | B2 * | 1/2005 | Collins | F42B 1/028 | 102/307 |
| 9,951,589 | B2 * | 4/2018 | Wilson | F42B 1/028 | |
| 10,227,851 | B2 * | 3/2019 | Collins | F42B 1/028 | |
| 11,220,891 | B2 * | 1/2022 | Metzger | F42B 1/028 | |
| 2001/0052303 | A1 | 12/2001 | Mayseless et al. | | |

(Continued)

FOREIGN PATENT DOCUMENTS

CN 205714129 U 11/2016

OTHER PUBLICATIONS

Notification of transmittal of the International Search Report and the Written Opinion of the International Searching Authority, or the Declaration, dated Aug. 18, 2020, PCT/US20/37622, 7 pages.

*Primary Examiner* — Samir Abdosh

(57) ABSTRACT

A shaped charge having a liner with three frustoconical segments and a bottom portion configured to provide consistent perforating holes over a range of distances from the shaped charge.

23 Claims, 4 Drawing Sheets

(56) References Cited

U.S. PATENT DOCUMENTS

| | | | | |
|---|---|---|---|---|
| 2002/0078850 | A1* | 6/2002 | Renfro | F42B 1/028<br>102/476 |
| 2004/0200377 | A1* | 10/2004 | Collins | F42B 1/032<br>102/476 |
| 2017/0122083 | A1* | 5/2017 | Wilson | F42B 1/028 |
| 2017/0199016 | A1 | 7/2017 | Collins et al. | |

* cited by examiner

TRI-ANGLED LINER WITH JET SHAPER

RELATED APPLICATIONS

This application claims priority to U.S. Provisional Application No. 62/860,682, filed Jun. 12, 2019.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Standard shaped charges have large variations in hole size that is dependent on the fluid clearance. In horizontal wells, where the perforating gun lies on the bottom side of the casing, these fluid clearances can vary drastically. While other techniques, such as mechanical centralizers can obtain a similar effect of minimizing variations, they have downsides—such as an increased risk of getting the tool string stuck. A perforation shaped charge that can obtain a consistent hole is the ideal solution.

SUMMARY OF EXAMPLE EMBODIMENTS

An example embodiment may include a shaped charge liner comprising a first frustoconical portion, a second frustoconical portion coupled to the first frustoconical portion via a first intersection, a third frustoconical portion coupled to the second frustoconical portion via a second intersection, and a bottom portion coupled to the third frustoconical portion via a third intersection, wherein the bottom portion shapes the explosive jet during detonation to achieve a consistent entry hole size in a well casing.

A variation of the example embodiment may include the first frustoconical angle of the first frustoconical portion may be between 40-70 degrees. The second frustoconical angle of the second frustoconical portion may be between 80-110 degrees. The third frustoconical angle of the third frustoconical portion may be between 50-90 degrees. The ratio of the height second portion and third portion combined to the total height of the liner may be between 0.5 and 0.7. The ratio of the height of the third portion to the total height of the liner may be between 0.1 and 0.4.

An example embodiment may include a shaped charge for perforating a tubular in a wellbore comprising a shaped charge casing with an inner surface, a liner further comprising: a first frustoconical portion, wherein the top of the first frustoconical portion is adjacent to the inner surface of the shaped charge casing, a second frustoconical portion coupled to the first frustoconical portion via a first intersection, a third frustoconical portion coupled to the second frustoconical portion via a second intersection, and a bottom portion coupled to the third frustoconical portion via a third intersection, wherein the bottom portion shapes the explosive jet during detonation to achieve a consistent entry hole size in a well casing, an explosive material between the liner and the shaped charge casing.

A variation of the example embodiment may include the inside intersection of the first frustoconical portion and the second frustoconical portion forming a fillet. The inside intersection of the second frustoconical portion and the third frustoconical portion may form a fillet. The inside intersection of the third frustoconical portion and the bottom portion may form a fillet. The inside intersection of the first frustoconical portion and the second frustoconical portion may form a chamfer. The inside intersection of the second frustoconical portion and the third frustoconical portion may form a chamfer. The inside intersection of the third frustoconical portion and the bottom portion may form a chamfer.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

The EquaFrac liner is a dense elongated tungsten liner. This type of liner uses the additional mass of the tungsten and the additional mass added by using longer liners, to help carry momentum across large fluid clearances. The momentum is carried in an elongated high-speed portion called a 'jet'. Any changes that affect the distribution of the weight of the liner affect the jet momentum, and consequently, the hole size. The example embodiments involve changing the shape of the jet instead of adding additional weight/momentum.

The example embodiments include a lower portion to purposefully disrupt/shape early formation of the liner jet. This disruption prevents further collapse of the liner jet creating a consistent entry hole (since the jet doesn't continue to collapse at large fluid clearances).

Figure 1A:
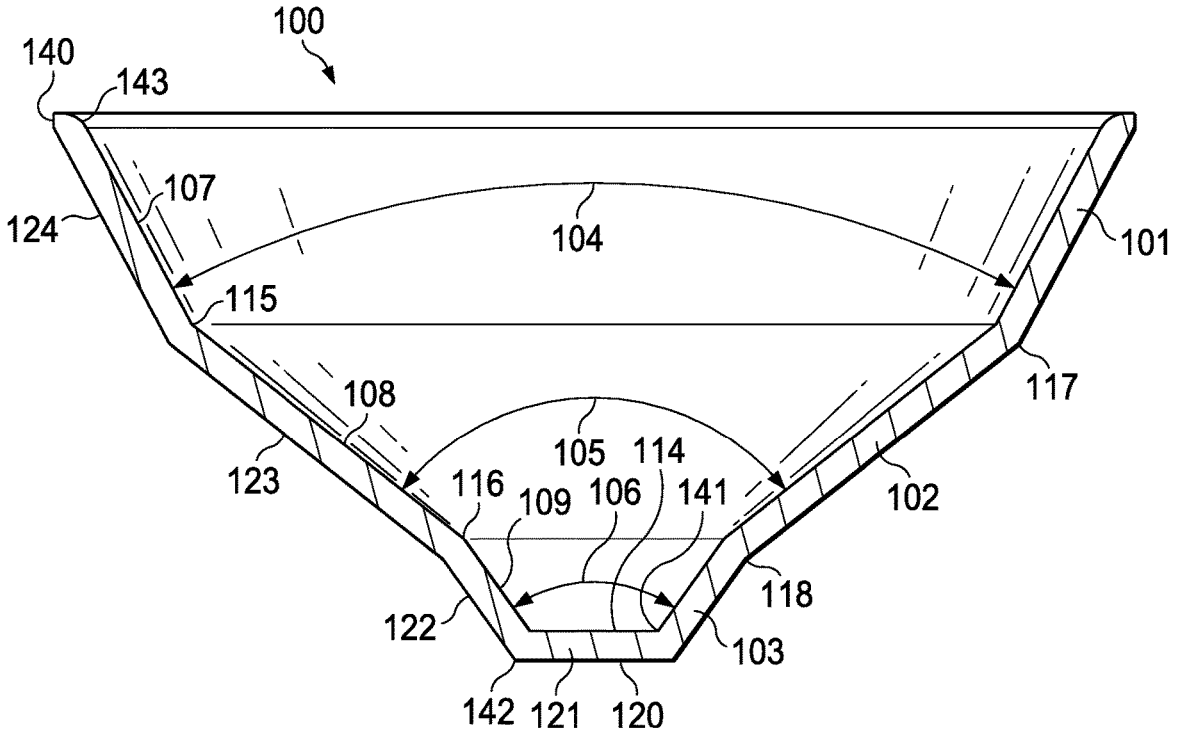
FIG. 1A shows an example embodiment of a cross section of a shaped charge liner.

An example embodiment is shown as a cross-section in FIG. 1A of the tri-angle liner 100. It includes a first frustoconical portion 101, a second frustoconical portion 102, a third frustoconical portion 103, and a bottom portion 121. The first frustoconical portion 101 includes a first inner surface 107, with a frustoconical angle 104, and a first outer surface 124. The second frustoconical portion 102 includes a second inner surface 108, with a frustoconical angle 105, and a second outer surface 123. The third frustoconical portion 103 includes a third inner surface 109, with a frustoconical angle 106, and a third outer surface 122. The bottom portion 121 includes a bottom inner surface 114 and a bottom outer surface 120. The intersection of the first frustoconical portion 101 with the second frustoconical portion 102 is defined by the first inner intersection 115 and the first outer intersection 117. The intersection of the second frustoconical portion 102 with the third frustoconical portion 103 is defined by the second inner intersection 116 and the second outer intersection 118. The intersection of the third frustroconical portion 103 and the bottom portion 121 is defined by the third inner intersection 141 and the third outer intersection 142. The top of the first frustoconical portion 101 includes a vertical flat 140. A curve or fillet 143 connects the top of the vertical flat 140 with the first inner surface 107. The example embodiment of 101 is shown with its exterior surfaces in FIG. 1B.

The first height 113 is measured from the plane coplanar with the bottom outer surface 120 and coplanar with the top of the first portion 101. The second height 111 is measured from the plane coplanar with the bottom outer surface 120 and coplanar with the first outer intersection 117. The third height 112 is measured from the plane coplanar with the bottom outer surface 120 and coplanar with the second outer intersection 118.

In one example embodiment the first frustoconical angle 104 can range between 50-70 degrees. The second frustoconical angle 105 can range between 90-110 degrees. The third frustoconical angle 106 can range between 60-90 degrees. The ratio of the second height 111 to the first height 113 is between 0.5 and 0.7. The ratio of the third height 112 and the first height 113 is between 0.1 and 0.2.

In one example embodiment, the first frustoconical angle 104 can range between 40-70 degrees. The second frustoconical angle 105 can range between 80-110 degrees. The third frustoconical angle 106 can range between 50-90 degrees. The ratio of the second height 111 to the first height 113 is between 0.5 and 0.7. The ratio of the third height 112 and the first height 113 is between 0.1 and 0.4.

An example embodiment of the liner 100 with more complex surfaces and intersections is shown in FIG. 2A-2F. The intersection of the first frustoconical portion 101 with the second frustoconical portion 102 is defined by the first inner intersection 115 and the first outer intersection 117. The intersection of the second frustoconical portion 102 with the third frustoconical portion 103 is defined by the second inner intersection 116 and the second outer intersection 118. The intersection of the third frustroconical portion 103 and the bottom portion 121 is defined by the third inner intersection 141 and the third outer intersection 142. The first inner surface 107, second inner surface 108, third inner surface 109, and the bottom inner surface 114 all combine to form the inner surface of the liner 100. The shape and geometry of the inner surface of the liner 100 controls the size of the jet and the distance the jet can propagate outwards while maintaining a desired diameter. The third frustroconical portion 103 disrupts and shapes the early formation of the explosive jet, thus preventing its collapse into a smaller diameter.

Figure 1B:
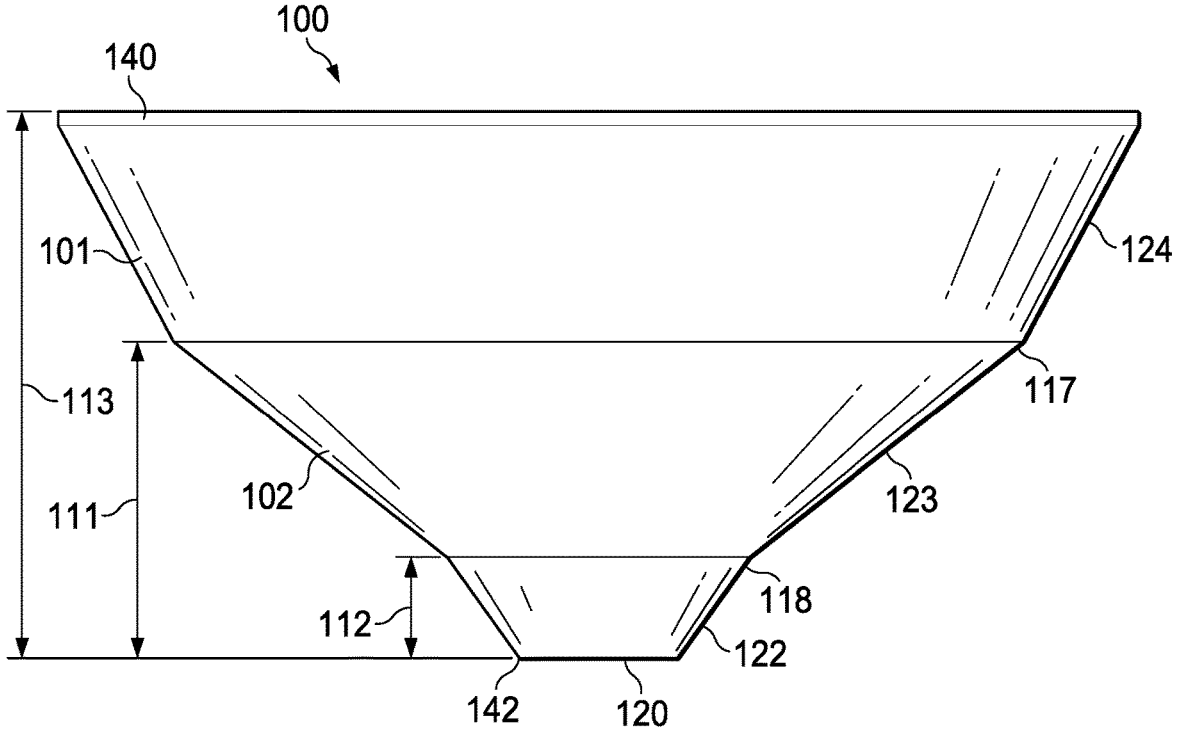
FIG. 1B shows an example embodiment of a shaped charge liner.
Figure 2A:
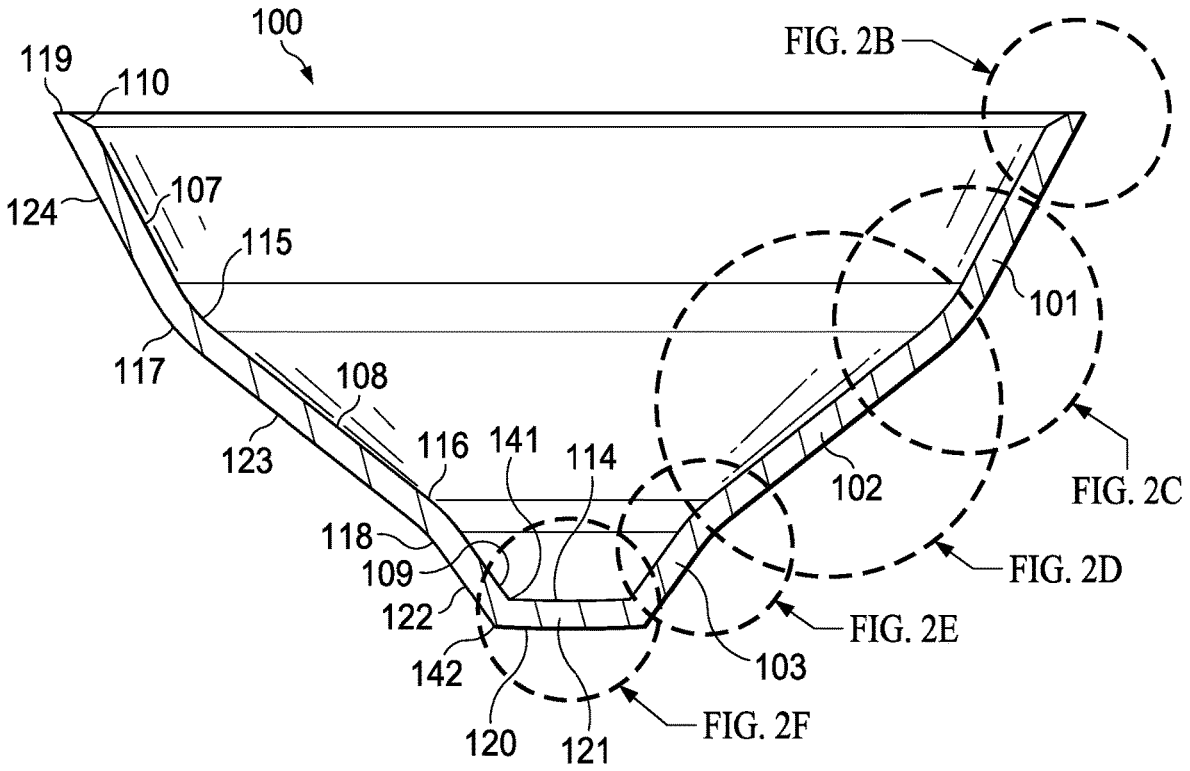
FIG. 2A shows an example embodiment of a cross section of a shaped charge liner.
Figure 2B:
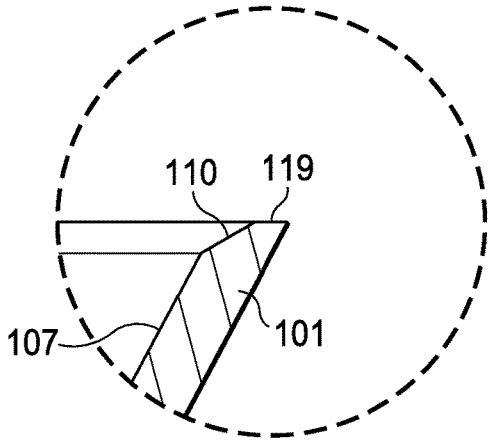
FIG. 2B shows a close up of an example embodiment of a cross section of a shaped charge liner.
Figure 2C:
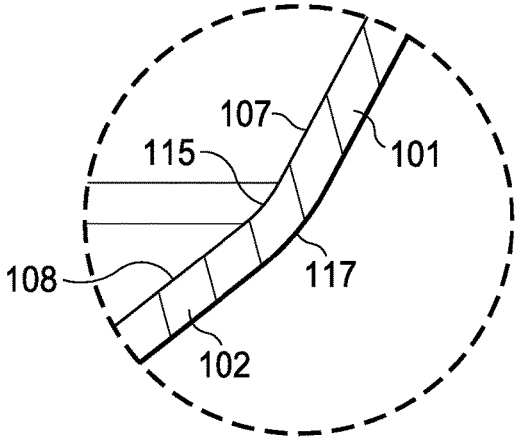
FIG. 2C shows a close up of an example embodiment of a cross section of a shaped charge liner.
Figure 2D:
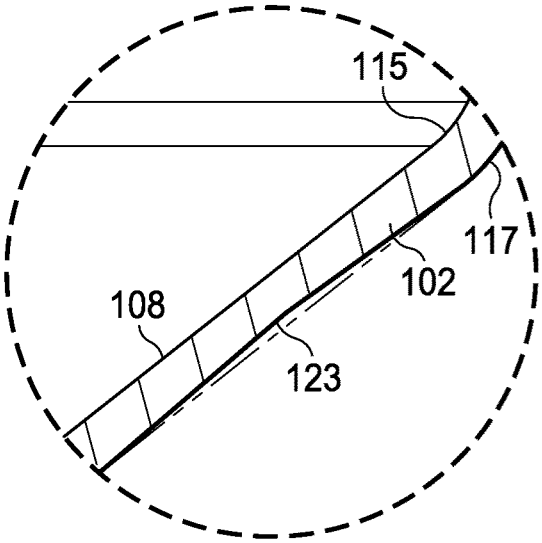
FIG. 2D shows a close up of an example embodiment of a cross section of a shaped charge liner.
Figure 2E:
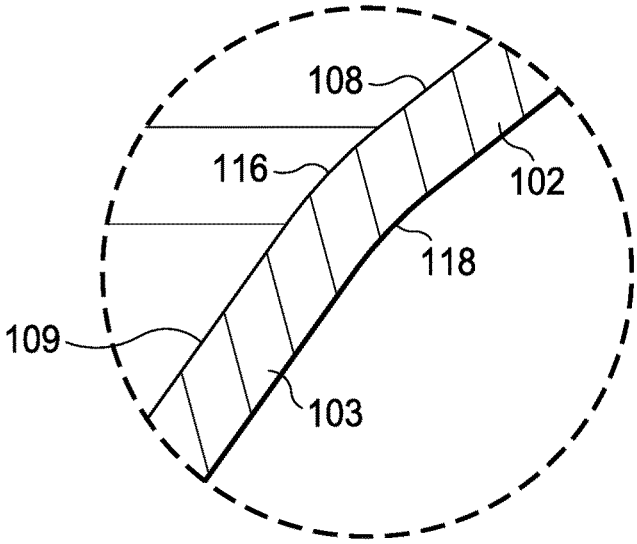
FIG. 2E shows a close up of an example embodiment of a cross section of a shaped charge liner.
Figure 2F:
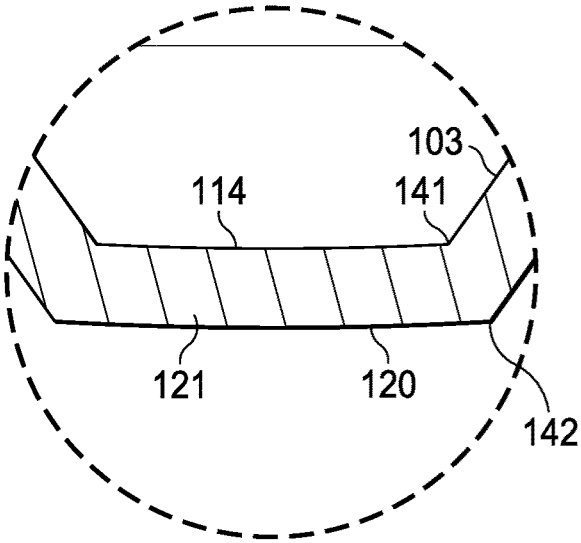
FIG. 2F shows a close up of an example embodiment of a cross section of a shaped charge liner.

A close up of the top of the first section 101 in FIG. 2B details a chamfer 110 and a top horizontal flat 119. A variation of the example embodiment may include a horizontal flat 119 with no chamfer 110, or it may include a chamfer 110 with no horizontal flat 119. A close up of the first inner intersection 115 and the first outer intersection 117 in FIG. 2C details how the breakpoints could be rounded or filleted, in addition to a single intersection point as shown in FIGS. 1A and 1B. Furthermore, the first inner intersection 115 and the first outer intersection 117 may be chamfered. A close up of the second section 102 in FIG. 2D details the second inner surface 108 and the second outer surface 123 may be straight or may be constructed of angled portions broken into multiple sections with less than 5 degrees of difference between them to form a more complex shape with a non-uniform thickness. A close up of an example embodiment in FIG. 2E details a chamfered second inner intersection 116 and chamfered second out intersection 118. Furthermore, the first inner intersection 116 and the first outer intersection 118 may be filleted or rounded. The bottom portion 121 is detailed in FIG. 2F. Both the bottom inner surface 114 and the bottom outer surface 120 are shown as flat and having a substantially uniform thickness. However, the bottom outer surface 120 may be conical, coming to a point. The third inner intersection 141 and the third outer intersection 142 may be chamfered, or filleted.

Figure 3:
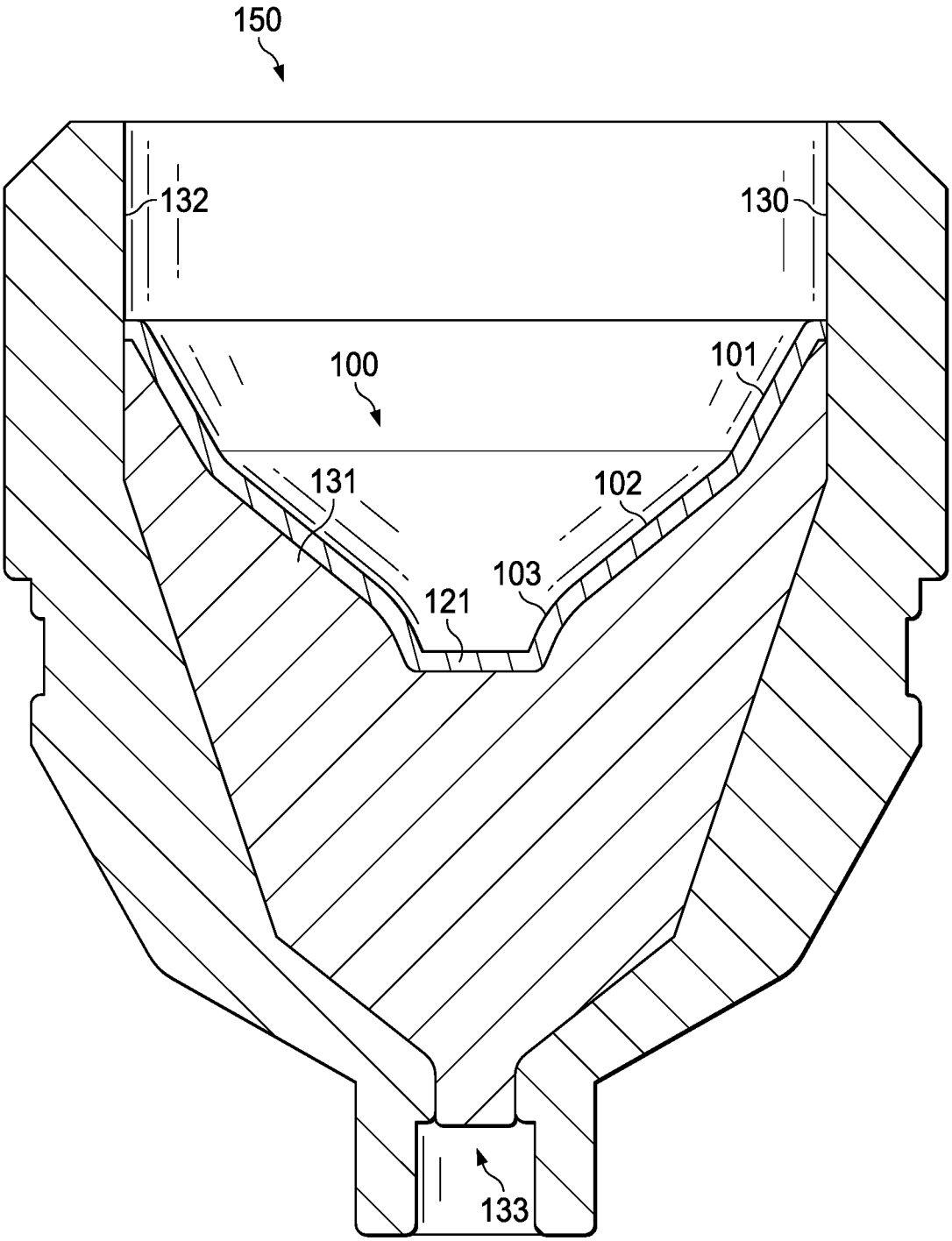
FIG. 3 shows an example embodiment of a cross section of a shaped charge.

A shaped charge 150 is shown in FIG. 3 comprising a casing 130 with an inner casing surface 132. The liner 100 disposed within the casing 130 and adjacent with the inner casing surface 132 has a first portion 101, a second portion 102, a third portion 103, and a bottom portion 121. An explosive material 131 is adjacent to the outer surfaces of the liner 100 and is adjacent to the inner casing surface 132. The opening 133 at the apex end of the shaped charge casing 130 allows a nearby energy source, such as explosive, kinetic, heating, etc, to initiate the explosive material 131.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A shaped charge liner comprising:

a first frustoconical portion;

a second frustoconical portion coupled to the first frustoconical portion via a first intersection;

a third frustoconical portion coupled to the second frustoconical portion via a second intersection; and a bottom portion coupled to the third frustoconical portion via a third intersection, wherein the bottom portion disrupts an explosive jet at its formation to prevent further collapse of the liner jet during detonation to achieve a consistent entry hole size in a well casing at a plurality of offset distances from the shaped charge.

2. The shaped charge liner of claim 1 wherein the first frustoconical angle of the first frustoconical portion is between 40-70 degrees.

3. The shaped charge liner of claim 1 wherein the second frustoconical angle of the second frustoconical portion is between 80-110 degrees.

4. The shaped charge liner of claim 1 wherein the third frustoconical angle of the third frustoconical portion is between 50-90 degrees.

5. The shaped charge liner of claim 1 wherein the ratio of the height of the second portion and combined with the third portion relative to the total height of the liner is between 0.5 and 0.7.

6. The shaped charge liner of claim 1 wherein the ratio of the height of the third portion to the total height of the liner is between 0.1 and 0.4.

7. The shaped charge liner of claim 1 wherein the inside intersection of the first frustoconical portion and the second frustoconical portion forms a fillet.

8. The shaped charge liner of claim 1 wherein the inside intersection of the second frustoconical portion and the third frustoconical portion forms a fillet.

9. The shaped charge liner of claim 1 wherein the inside intersection of the third frustoconical portion and the bottom portion forms a fillet.

10. The shaped charge liner of claim 1 wherein the inside intersection of the first frustoconical portion and the second frustoconical portion forms a chamfer.

11. The shaped charge liner of claim 1 wherein the inside intersection of the second frustoconical portion and the third frustoconical portion forms a chamfer.

12. The shaped charge liner of claim 1 wherein the inside intersection of the third frustoconical portion and the bottom portion forms a chamfer.

13. A shaped charge for perforating a tubular in a wellbore comprising:

a shaped charge casing with an inner surface;

a liner further comprising: a first frustoconical portion, wherein the top of the first frustoconical portion is adjacent to the inner surface of the shaped charge casing;

a second frustoconical portion coupled to the first frustoconical portion via a first intersection;

a third frustoconical portion coupled to the second frustoconical portion via a second intersection;

a bottom portion coupled to the third frustoconical portion via a third intersection, wherein the bottom portion disrupts the formation of the explosive jet early in its formation to achieve a consistent diameter to create a consistent entry hole size in a well casing at a plurality of distances from the shaped charge; and an explosive material between the liner and the shaped charge casing.

14. The shaped charge liner of claim 13 wherein the first frustoconical angle of the first frustoconical portion is between 40-70 degrees.

15. The shaped charge liner of claim 13 wherein the second frustoconical angle of the second frustoconical portion is between 80-110 degrees.

16. The shaped charge liner of claim 13 wherein the third frustoconical angle of the third frustoconical portion is between 50-90 degrees.

17. The shaped charge liner of claim 13 wherein the ratio of the height second portion and third portion combine to the total height of the liner is between 0.5 and 0.7.

18. The shaped charge liner of claim 13 wherein the ratio of the height of the third portion to the total height of the liner is between 0.1 and 0.4.

19. The shaped charge liner of claim 13 wherein the inside intersection of the first frustoconical portion and the second frustoconical portion forms a fillet.

20. The shaped charge liner of claim 13 wherein the inside intersection of the second frustoconical portion and the third frustoconical portion forms a fillet.

21. The shaped charge liner of claim 13 wherein the inside intersection of the third frustoconical portion and the bottom portion forms a fillet.

22. The shaped charge liner of claim 13 wherein the inside intersection of the first frustoconical portion and the second frustoconical portion forms a chamfer.

23. The shaped charge liner of claim 13 wherein the inside intersection of the second frustoconical portion and the third frustoconical portion forms a chamfer.

* * * * *